US008935110B2

(12) United States Patent
Hsieh et al.

(10) Patent No.: US 8,935,110 B2
(45) Date of Patent: Jan. 13, 2015

(54) APPARATUS FOR ANALYSING AN INTERIOR ENERGY SYSTEM

(75) Inventors: Mark Chang-Ming Hsieh, Cambridge (GB); David Russell Anderson, Royston (GB)

(73) Assignee: The Technology Partnership PLC, Hertfordshire (GB)

( * ) Notice: Subject to any disclaimer, the term of this patent is extended or adjusted under 35 U.S.C. 154(b) by 753 days.

(21) Appl. No.: 13/125,794

(22) PCT Filed: Oct. 26, 2009

(86) PCT No.: PCT/EP2009/064055

§ 371 (c)(1), (2), (4) Date: Jul. 25, 2011

(87) PCT Pub. No.: WO2010/046498

PCT Pub. Date: Apr. 29, 2010

(65) Prior Publication Data

US 2011/0276288 A1 Nov. 10, 2011

(30) Foreign Application Priority Data

Oct. 24, 2008 (GB) ..... 0819586.9
Oct. 24, 2008 (GB) ..... 0819587.7

(51) Int. Cl.
*G01R 21/00* (2006.01)
*F22B 35/00* (2006.01)
(Continued)

(52) U.S. Cl.
CPC ..... *F24D 19/1009* (2013.01)
USPC ..... 702/60; 236/22; 237/71

(58) Field of Classification Search
USPC ..... 702/60, 33, 35–36, 50, 81, 84, 99–100, 702/127, 130, 136, 182–185, 188–189; 236/1 C, 21 B, 22, 34, 36, 44 C, 44 R, 236/46 R; 237/2 A, 8 A, 8 B, 8 R, 56, 70–71; 700/274–278; 703/7, 9
See application file for complete search history.

(56) References Cited

U.S. PATENT DOCUMENTS

2004/0034484 A1 2/2004 Solomita, Jr. et al.
2006/0065750 A1 3/2006 Fairless
(Continued)

FOREIGN PATENT DOCUMENTS

DE 10057834 A1 6/2002
DE 10 2006 04288 A1 6/2007
(Continued)

OTHER PUBLICATIONS

Kreuzinger et al., Design of a Combined Quasi-Linear Distributed State and Online Parameter Estimator for a Stratified Storage Tank, Oct. 4-6, 2006, Proceedings of the 2006 IEEE, International Conference on Control Applications, Munich, Germany, pp. 680-685.*
(Continued)

*Primary Examiner* — Toan Le

(57) ABSTRACT

A system for analyzing an interior energy system including: at least one detachable sensor arranged to monitor a portion of the interior energy system; and an apparatus including a processor configured to receive data of a first parameter of the interior energy system from the at least one detachable sensor and determine a second parameter of the interior energy which is inferred on the basis of the received data of the first parameter; and determine a characteristic of the interior energy system from the determined second parameter. The system may provide analysis of the interior energy system and recommend improvements.

41 Claims, 4 Drawing Sheets

(51) Int. Cl.
*F24H 3/00* (2006.01)
*F24D 19/10* (2006.01)

(56) References Cited

U.S. PATENT DOCUMENTS

| | | | |
|---|---|---|---|
| 2006/0241785 | A1 | 10/2006 | Krocker et al. |
| 2007/0175883 | A1 | 8/2007 | Miu et al. |
| 2008/0082183 | A1 | 4/2008 | Judge |

FOREIGN PATENT DOCUMENTS

| | | | |
|---|---|---|---|
| EP | 0801365 | A2 | 10/1997 |
| EP | 1355212 | A1 | 10/2003 |
| EP | 1 967 922 | A2 | 9/2008 |
| GB | 2065334 | A | 6/1981 |
| GB | 2 445 686 | A | 7/2008 |
| WO | WO 02/54165 | A2 | 7/2002 |
| WO | WO 2008/039065 | A1 | 4/2008 |
| WO | WO 2008/094864 | A2 | 8/2008 |

OTHER PUBLICATIONS

International Search Report dated Nov. 6, 2012 in connection with International Patent Application No. PCT/EP2009/064055, 5 pages.

Written Opinion of International Searching Authority dated Nov. 6, 2012 in connection with International Patent Application No. PCT/EP2009/064055, 7 pages.

* cited by examiner

APPARATUS FOR ANALYSING AN INTERIOR ENERGY SYSTEM

CROSS-REFERENCE TO RELATED APPLICATION(S)

The present application claims priority under 35 U.S.C. §365 to International Patent Application No. PCT/EP2009/064055 filed Oct. 26, 2009, entitled "AN APPARATUS FOR ANALYSING AN INTERIOR ENERGY SYSTEM". International Patent Application No. PCT/EP2009/064055 claims priority under 35 U.S.C. §365 and/or 35 U.S.C. §119(a) to United Kingdom Patent Application No. 0819586.9 filed Oct. 24, 2008 and United Kingdom Patent Application No. 0819587.7 filed Oct. 24, 2008 which are incorporated herein by reference into the present disclosure as if fully set forth herein.

The present invention relates to analysing an interior energy system and in particular but not exclusively, to a heating system.

Domestic heating and electrical heating and power systems are typically fitted and configured for general use. It has been noted that such domestic heating systems and electrical power systems are then rarely managed by the users.

For example, it is exceptional for the user to fully understand the configuration, operation and control of all the elements of their domestic heating and electrical power system.

The average user is limited in their understanding and management of their domestic heating and electrical power system because there is no comprehensive user documentation available regarding the installed configuration, operation management, and maintenance of their domestic heating and electrical power systems.

Furthermore, standard systems do not incorporate a user interface to display details about the state and performance of various parts the system, so unless the user employs an expert to examine the heating system and electrical power system, they receive insufficient feedback regarding the state and performance of the domestic heating and electrical power system.

Devices are known to monitor and display ambient temperature or humidity of a room and, for example, electrical usage of a particular appliance.

The inventors had noted that the user is hindered by the lack of information to understand and manage their domestic heating and electrical power system. In this way, a user is typically unable to continuously monitor and adjust their system to improve performance, cost savings and levels of comfort in the domestic environment.

It is an aim of some embodiments of the invention to address or to at least mitigate at least one of the disadvantages of problems discussed above.

In a first aspect there is provided an apparatus for analysing an interior energy system comprising:

a processor configured to receive data of a first parameter of the interior energy system from at least one detachable sensor, the at least one detachable sensor being arranged to monitor a portion of the interior energy system;

determine a second parameter of the interior energy system using the received data of the first parameter; and determine a characteristic of the interior energy system from the determined second parameter.

Preferably the second parameter relates to another different portion of the interior energy system.

Preferably the second parameter is not directly determinable with the at least one detachable sensor.

Preferably the processor is configured to provide information comprising an analysis of the interior energy system based on the determined characteristic.

Preferably the processor is configured to determine the second parameter on the basis of the received data of the first parameter and a stored value.

Preferably the stored value is inputted by the user, received from a remote server or installed as a factory setting.

Preferably the processor is configured to determine the second parameter using a modelling algorithm and the received data.

Preferably the information comprises a recommendation for a user to modify their behavioural use of the interior energy system and/or the building.

Preferably the information comprises any of the following: a suggested modified configuration of all or a portion of the interior energy system, detection of a fault in all or a portion of the interior energy system and/or maintenance in all or a portion of the interior energy system.

Preferably the information comprises an indication to manually adjust the configuration of the interior energy system and/or at least a portion of the interior energy system.

Preferably the interior energy system is any of the following: an electric heating system, a gas heating system, an oil heating system, a combined heat and power system, a bio-fuel power system a solid fuel heating system, a hot water system, an electrical supply system and an air conditioning system.

Preferably the processor is configured to determine if further data is required for determining a characteristic of the interior energy system on the basis of the received sensor data.

Preferably the processor is configured to determine a parameter of the at least one detachable sensor to modify on the basis on the data.

Preferably the processor is configured to provide information on the parameter of the at least one detachable sensor to be modified.

Preferably the parameter of the at least one detachable sensor is any of the following: location or configuration of the at least one detachable sensor, or timing configuration of when the at least one detachable sensor monitors the interior energy system.

Preferably the processor is configured to determine if further data is required for determining the second parameter of the interior energy system on the basis of the received sensor data.

Preferably the information comprises a request for additional sensors to monitor the interior energy system and to send data to the apparatus.

Preferably the first and/or second parameter is one or more of the following parameters: temperature of a hot water tank of the interior energy system, the flow rates of the water in pipes of the interior energy system, calorific consumption of a boiler of the interior energy system, the efficiency of the boiler of the interior energy system, timer settings of the interior energy system, settings of at least one thermostat of the interior energy system, burning periods of the boiler, usage periods of the interior energy system, quantity of insulation of the building, quantity of solar heating of the building, temperature of one or more pipes, temperature of water in one or more pipes and temperature of water in the hot water tank or other water bearing component of the interior energy system, heat transfer between components of the interior energy system or interior or exterior portions of the building, position of at least one valve of the interior energy system, dimensions of at least one component of the interior energy system, dimensions of at least one portion of the building.

Preferably the processor is configured to receive the data from the at least one detachable sensor via a wireless network.

Preferably the processor is configured to receive the data from the at least one detachable sensor via a hub and/or server over a wireless network.

Preferably the processor is configured to further determine a characteristic of the interior energy system to be modified on the basis of data regarding meteorological information and/or seasonal information.

Preferably the data regarding the external factors is received from a remote server and/or is stored in the apparatus.

Preferably the processor is configured to further determine a characteristic of the interior energy system on the basis of timing data of when the climate system in use.

Preferably the at least one detachable sensor is a temperature sensor configured to monitor one or more of the following: a heating pipe of the interior energy system, a water pipe, the ambient temperature of a portion of the building, the temperature of a radiator of the interior energy system, the temperature of a hot water tank of the interior energy system, and the temperature of an object which is in a portion of the building.

Preferably the characteristic determined by the processor is one or more of the following; the energy consumption in the interior energy system, the efficiency of the interior energy system, faults of the interior energy system, required maintenance of the interior energy system, the energy generation of the interior energy system and potential improvements of the interior energy system.

Preferably the processor provides information to improve the efficiency of the interior energy system.

Preferably the at least one detachable sensor is an electrical power consumption sensor configured to monitor one or more of the following: a single electrical appliance, a plurality of electrical appliances and all electrical appliances in a building.

Preferably the interior energy system comprises at least two different interior energy sub-systems and the processor is configured to determine a characteristic of one or both of the interior energy sub-systems.

Preferably the processor is configured to compare the sub-systems on the basis of the characteristics and provide information of the comparison.

Preferably the interior energy sub-systems are one or more of the following: an electric heating system, a gas heating system, a solid fuel heating system, a hot water system, an air conditioning system, an electrical supply system, an oil heating system, a combined heat and power system and a bio-fuel power system.

Preferably the second parameter is not directly measurable from the received data.

Preferably installation of the apparatus is non-disruptive such that no modification or replacement of the interior energy system is required.

Preferably the processor is configured to determine parameters in order of a priority of the parameters.

Preferably the processor is configured to access a data tree comprising a hierarchical evaluation the parameters.

Preferably the processor is further configured to determine the second parameter from one or more parameters other than the first parameter.

Preferably the processor receives data for the one or more parameters from one or more other detachable sensors.

Preferably the processor is configured to provide information on the characteristic of the interior energy system to be modified.

Preferably the processor is configured to send the information in a message.

Preferably the information comprises a indication to upgrade a portion of the interior energy system and/or to carry out maintenance of a portion of the interior energy system.

Preferably when the processor determines that the characteristic of the interior energy system is a fault in the interior energy system.

Preferably when the processor determines a fault with the interior energy system and the information comprises an indication to repair the interior energy system.

Preferably the processor is configured to determine that more data is required to analyse the interior energy system.

Preferably the information is displayed to the user.

Preferably the information is provided to the user using one or more of the following: displaying the information in a display means of the apparatus, sending an indication to a user terminal or an indication to the user via the user terminal.

Preferably the temperature sensor monitors any one of a heating pipe of the interior energy system, a water pipe or the ambient temperature of a portion of the building. Alternatively or additionally, the temperature sensor monitors the temperature of a radiator and/or a hot water tank of the interior energy system. Alternatively or additionally, the temperature sensor monitors the temperature of an object in a portion of the building. The object may be neither part of the interior energy system nor the building. In some embodiments the object may be an item of clothing or furnishing in the building.

Preferably the processor is configured to determine the characteristics of a building comprising the interior energy system to be modified.

Preferably the processor is configured provide information on the characteristic of the building system to be modified.

Preferably the processor is configured to provide information for modifying one or both of the interior energy subsystems.

Preferably the apparatus is configured to determine a characteristic for each of a plurality of interior energy systems.

In a second aspect there is provided a user terminal comprising the apparatus according to claims 1 to 31 wherein the user terminal is any of the following: a server, a personal computer, a mobile telephone, a personal digital assistant and a laptop.

In a third aspect there is provided a system for analysing an interior energy system comprising:

at least one detachable sensor arranged to monitor a portion of the interior energy system; and an apparatus comprising a processor configured to receive data of a first parameter of the interior energy system from the at least one detachable sensor determine a second parameter of the interior energy using the received data of the first parameter; and determine a characteristic of the interior energy system from the determined second parameter.

Preferably the controller is configured to receive the data from the at least one sensor via a hub or server over a wireless network.

Preferably the at least one sensor is a plurality of sensors, each sensor monitoring a different portion of the interior energy system.

In a fourth aspect there is provided a method of analysing an interior energy system comprising:

receiving data of a first parameter of the interior energy system from at least one detachable sensor arranged to monitor a portion of the interior energy system;

determining a second parameter of the interior energy system using the received data of the first parameter; and determining a characteristic of the interior energy system from the determined second parameter.

In a fifth aspect there is provided computer program comprising code means adapted to perform the method of the fourth aspect when the program is run on a processor.

For a better understanding of the present invention and as to how the same may be carried out into effect, reference will now be made by way of example to the accompanying drawings in which.

Various embodiments are described. However, such embodiments are presented for the purposes of illustrating the present invention and do not limit the scope thereof.

Advantageously, the arrangements as provided by some embodiments of the present invention adaptively survey and test the configuration of a domestic heating system. This means that energy usage and operational performance of a domestic heating and electrical power system is monitored and analysed. This provides interactive feedback and recommendations to a user to improve operational performance of their heating and electrical power system.

Figure 1:
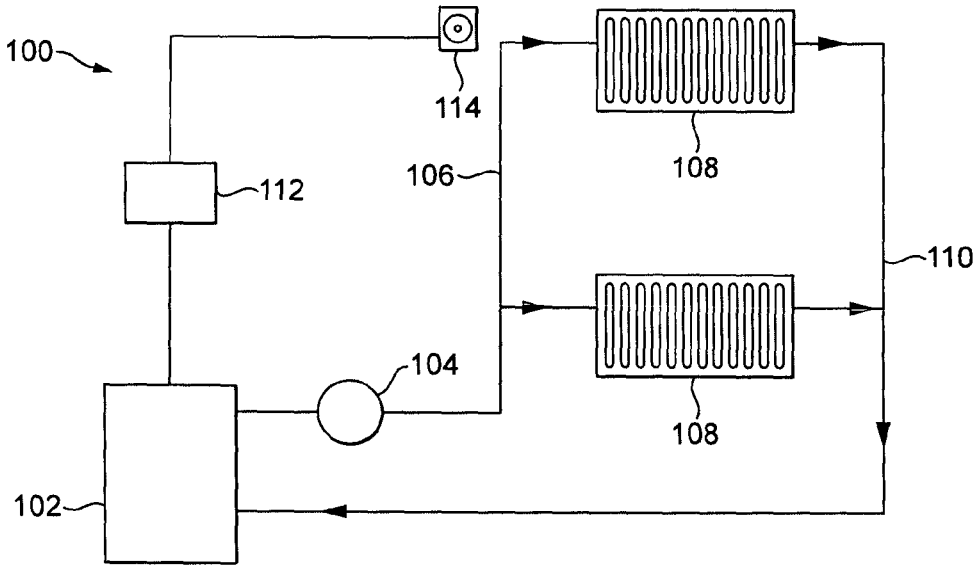
FIG. 1 illustrates a schematic representation of a typical heating system.

FIG. 1 illustrates a typical interior energy system 100 in a domestic environment. The interior energy system typically controls the electrical power and/or heating in a building. Additionally or alternatively, the interior energy system provides energy to the building. The building is a domestic building such as a house or a flat. Optionally the building is a commercial or industrial building such as a factory, office, shop, warehouse or the like. In this way, the energy provision and control system controls environmental conditions in the interior of a building. The interior energy system is a stored heating system but is alternatively an air conditioning system, electrical heating system, electrical power system or a water heating system or any combination of one or more of the above. Additionally the interior energy system includes local energy generation systems such as solar panels, bio-fuel power generator, an oil heating system combined heat and power systems and/or wind turbines to offset the energy consumption of, for example, the heating system.

The heating system 100 has a heating means 102, for example a boiler. The boiler 102 heats water to be moved through the heating system 100. Typically, a boiler 102 is a gas fuelled boiler wherein gas is burnt to heat cold water in the boiler. Alternatively, other methods of heating the water are used such as an electrical element or solid fuel heating. After heating, the hot water is transported from the boiler around the heating system via a pump 104. The pump moves the hot water through the heating pipes 106 to areas of the domestic environment which require heating. The heating pipes 106 are connected to radiators 108. Typically radiators have a large surface area for conductive and convective heating of the domestic environment. After heat from the hot water has been transferred to the domestic environment via the radiators 108 the colder water is transported back to the boiler for re-use.

In a typical heating system 100 the boiler will be controlled via a programmer 112. The programmer 112 can be set to provide a timer function for operating the boiler 102. In this way, the programmer 112 permits a user to specify certain times of day to use the heating system. A thermostat 114 is connected to the programmer 112. The thermostat typically detects the ambient temperature in the domestic environment and provides feedback signals to the programmer 112 to regulate the amount of heating delivered to the domestic environment. In this way, the combination of the thermostat 114 and the programmer 112 regulate the temperature of a domestic environment e.g. in a room of a house.

However, when using such a system, the user receives no feedback about the state and performance of the system other than whether the heating system is operational or not. The user receives no other indication regarding the state and performance of the heating system.

Figure 2:
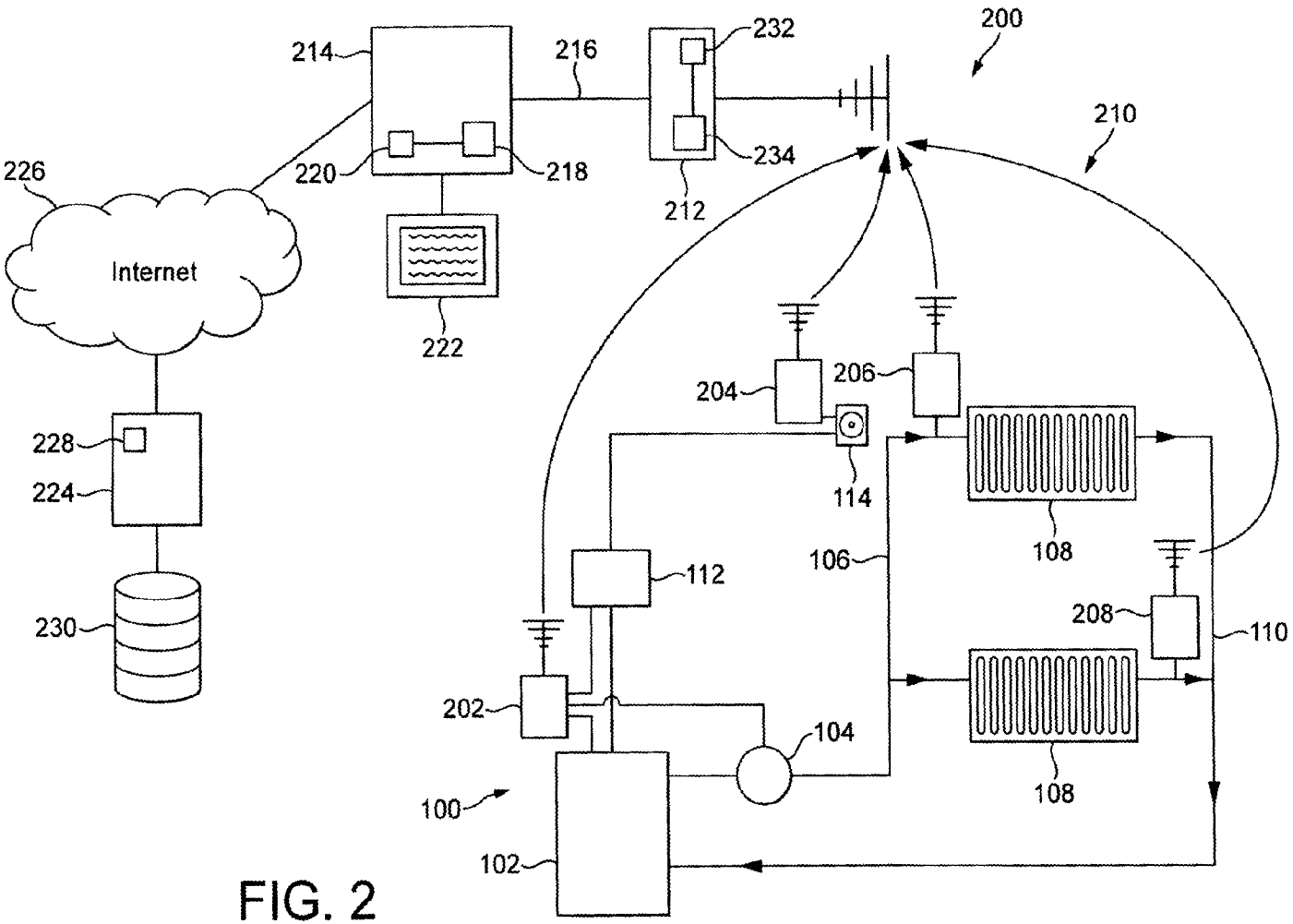
FIG. 2 illustrates a schematic representation of a first embodiment of the present invention.

FIG. 2 discloses a heating system 100 as described in FIG. 1 in combination with a first embodiment of the present invention.

FIG. 2 discloses a system 200 for analysing an interior energy system e.g. the heating system 100. The heating system may be unknown before the analysing system monitors the heating system. That is, the analysing system has not determined characteristics and/or parameters of the heating system. In an alternative embodiment, the analysing system may have previously determined characteristics and/or parameters of the heating system (e.g. when the analysing system is reinstalled). The system 200 comprises sensors 202, 204, 206 and 208. The sensors 202, 204, 206 and 208 monitor different components of the heating system 100. The sensors may monitor the same or different parameters. Optionally, the sensors may monitor more than one parameter of the heating system. The sensors shown in FIG. 2 are by way of example and by no way limits the number or placement of the sensors throughout a heating system 100. Typically, the sensors are placed adjacent to critical components of a heating system such as a radiator 108. For example, a sensor is placed on an input heating pipe 106 or alternatively a sensor is placed on an output heating pipe 110. Additionally, a sensor is placed on both the input heating pipe 106 and the output heating pipe 110. Sensors are also used to determine the ambient temperature in a room or another area of a domestic environment. For example, a sensor 204 is placed next to the thermostat 114. Furthermore, a sensor 202 is used to monitor the operation of the programmer 112, the pump 104 and/or the boiler 102.

The plurality of sensors 202, 204, 206 and 208 are connected to a wireless network 210. The wireless network 210 is a wireless LAN and operates in accordance with a proprietary standard. Alternatively or additionally, the wireless network is an IEEE 802.11 standard network, a Bluetooth™ network, a WiBree™ network, or any other type of unlicensed wireless network or a licensed wireless network such as GSM or 3G. In an alternative embodiment, the sensors 202, 204, 206 and 208 are connected to a wired network. Alternatively, the data sent from the sensors is forwarded by any of the following: a wireless router, a wireless network switch or any other suitable network node.

The wireless sensors 202, 204, 206 and 208 are connected over the wireless network 210 to a wireless hub 212. The wireless hub has a processor 232, and local memory 234. The wireless hub receives and stores the data from the sensors 202, 204, 206 and 208, and forwards the data to the local server 214 at any later time. The wireless hub is connected to the local server via a wireless network 216. The wireless network 216 is a wireless LAN and operates in accordance with the Bluetooth™ Standard. Alternatively or additionally, the wireless network 216 is an IEEE 802.11 standard network, a WiBree™ network, or any other type of unlicensed wireless network or a licensed wireless network such as GSM or 3G. In an alternative embodiment, the wireless hub is connected to the local server via a wired network. In another alternative embodiment, a user terminal, for example a user terminal, receives the data from the wireless sensors and sends the sensor data via a cellular network to the local server 214.

The local server has a processor 218, a local memory 220 and a display means 222 for displaying information to a user.

The local server processes the data received from the sensors and provides analysis and feedback as described hereinafter. Optionally, the local server 214 is located in proximity to the heating system, for example in the same house or building.

The local server is connected to a remote server 224 over the internet 226 or other suitable network. The remote server has a processor 228 and a storage means 230. The remote server 224 provides information and/or analysis on request to the local server not available at the local server. Alternatively, the remote server 224 provides information autonomously. That is, the remote server provides information to the local server without a request from the local server. In an alternative embodiment the local server 214 is another remote server and the wireless hub communicates over a network, for example over a domestic broadband internet connection.

Figure 3:
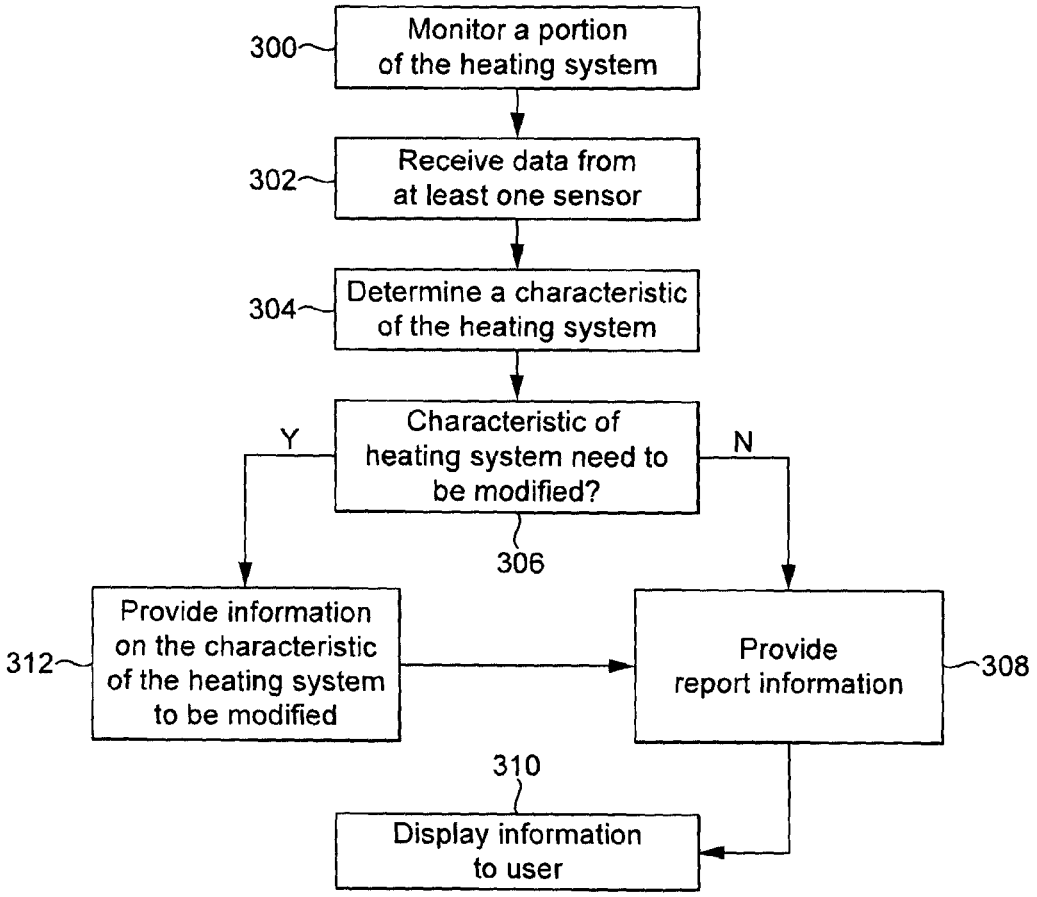
FIG. 3 illustrates a flow diagram representation of the first embodiment of the present invention.

With reference to FIG. 3, the operation of the apparatus for analysing a heating system will be described.

As mentioned above, the sensors 202, 204, 206 and 208 are placed adjacent to a portion of the heating system 100. For example, sensors 206 and 208 monitor the temperature of input and/or output heat pipes into radiators 108. The sensors log the temperature periodically. Typically, the sensors periodically measure and/or monitor the portion of the heating systems every minute. In an alternative embodiment the frequency of the periodic monitoring can be altered (e.g. every second, 10 seconds, 30 seconds, 2 minutes, 5 minutes, 10 minutes etc). The step of monitoring a portion of the heating system is shown in 300.

The sensors send packets of data over the wireless network 210 and are received at the wireless hub 212. Optionally, the wireless sensors are arranged to sequentially transmit data over the wireless network to reduce the bandwidth required for the monitoring data sent via the sensors.

The wireless hub 212 forwards the packets of data received from at least one sensor to the local server 214 via the wireless network 216. This is shown in step 302.

The packets of data received at the local server 214 are processed by processor 218.

The processor determines a characteristic of the heating system as shown in step 304.

For example in an embodiment the processor analyses the data received from the sensors to survey the heating system's configuration.

The packets of data received from the wireless sensors 202, 204, 206 and 208 include a header portion and a data portion. The header portion contains parameters regarding the type of sensor, the type of component which the sensor is monitoring in the heating system, the frequency of the monitoring, and other configuration information/or analysing the data. Alternatively, or additionally the header comprises sensor identification code, wherein the processor determines the parameters of the sensor by looking up the sensor identification code from stored memory. Optionally, the header includes system identification code for the processor to determine which interior energy system the sensor is monitoring in the event of multiple interior energy systems in a building. In this way the header portion permits the header process 218 to identify one sensor from a plurality of sensors. The data portion typically includes logging information such as temperature measurements, timings, power consumption and other monitoring information.

In some embodiments the processor 218 provides information to an apparatus regarding the configuration of the analysing system. In some embodiments the configuration may comprise installation of the analysing system. In some embodiments, installation of the analysing system may comprise a single operation, for example a one-off activity of locating a single sensor. In other embodiments, installation of the analysing system may comprise multiple operations, for example positioning a plurality of sensors at a plurality of locations of the interior energy system. Alternatively, in other embodiments configuration may comprise adjusting the existing settings of the interior energy system.

For example in one embodiment, initially there are no sensors monitoring the heating system 100, but the apparatus is in communication with the local server 214.

The local server provides instructions for displaying on a display screen of the apparatus. The apparatus may be a computer, a mobile telephone, a personal digital assistant or any other user terminal. In this way, the user can install the sensors and set up the analysing system with out additional support or expert help. For example, the user terminal will instruct the user to install the sensor 206 on the input water pipe 106 to the radiator 108. The user terminal receives sensor data monitoring the input water pipe and transmits the sensor data to the local server. The processor 218 determines whether the placement and configuration of the sensor 206 is correct. If the sensor needs adjustment, the processor sends information for displaying on the user terminal. On correct placement and set up of the sensor, the processor sends information to the terminal to indicate that the installation of the sensor is correct and complete.

A user terminal may improve installation of the analysing system because the user receives instructions from the analysing system. In this way, feedback and modification of the analysing system on setup is quicker and typically introduces less errors when placing the sensors in their intended positions.

The installation of the analysing system is non-disruptive in that it does not require modification or replacement of the heating system on setup. The placement of the sensors is not intrusive to the heating system and a user does not require expert help on setup of the analysing system. Typically the sensors tie on or snap on to parts of the heating system, such as a water pipe, to monitor usage and other parameters of the heating system. The fact that the analysing system does not require replacement of a portion of the heating system means that irreversible changes are not made to the heating system when installing the analysing system.

Step 304 will now be described for the embodiment of the invention which determines the efficiency of the heating system.

The processor analyses temperature information from sensors 206 and 208 located near radiators of the heating system and receive ambient temperature information from a temperature sensor 204 near the thermostat. The local server 214 further receives data from boiler sensor 202 which logs the operational usage of the boiler. In this way, the wireless sensors provide information to the local server for analysing the heat efficiency of the heating system. An estimate of energy usage is made from measuring the temperature of the input heat pipes 106, the temperature of the output pipes 110, the temperature increase of a room and boiler operational usage information. Therein, the system can estimate the energy consumed by the boiler to heat up a room with radiators 108 measured by the temperature sensor 204.

For example, the processor analyses the time taken for a temperature of a room to rise and determines the energy used by a boiler and compares this with known or typical values for a heating system in normal operation. The energy consumed by the heating system 100 and its efficiency are therefore determined. The efficiency of the heating system is sent to a user in a diagnostic report as set out in step 308.

The information is displayed to the user as shown in 310 in display means 222 connected to the local server.

In an alternative embodiment, the information is sent to a user terminal for displaying on the user terminal or sent via a user terminal to a separate display means. In an alternative embodiment the apparatus analyses the heating system and can detect anomalies in the system and/or fault detection.

For example, at step 304 the processor 218 determines that a room heats up over an abnormally long period of time and the processor then determines that the efficiency of the heating system is low. For example, in one embodiment the temperature sensors 206 and 208 indicate that the temperature variation between the input heat pipes 106 and the output heat pipes 110 is lower than normal. Therefore, the processor 218 can determine that the radiators 108 are not providing sufficient conduction and/or convection to a room in the building.

Therefore, the processor 218 in step 306 determines that a characteristic of the heating system needs to be modified. For example the processor determines that there is a fault with the radiators 108.

Therefore, the processor 218 determines that information on modifying the radiators of the heating system needs to be provided to the user as shown in step 312. After step 312, the processor 218 generates report information as described above in step 308. The report information includes information on the characteristic of the heating system to be modified. The processor 218 compares the fault with a list of known faults stored in local memory 220. The list of known faults is linked to a list of remedies associated with each fault. Therefore, the processor generates a list of possible solutions for correcting the fault in the heating system 100.

The processor 218 then generates a message and displays the message in display monitor 222. The user is then able to read the message e.g. "bleed air out of the radiators" and attempt to correct the fault with the suggested remedy.

In an alternative embodiment, the processor 218 in step 204 determines when the heating system is required and to what extent. The local server 214 receives additional sensor information providing data on presence of a user in a building or room and determine if heating is required. The additional sensor is not shown. Alternatively or additionally, the user inputs times when the user is in the building and requires heating. The processor then determines, based on the presence of a user, a pattern of demand for heating from the heating system. For example, the heating system 100 can also provide hot water from hot water taps (not shown).

Typically, the reservoir of hot water is limited and therefore at certain times the capacity of hot water may be exceeded. In such instances, an alternative heating supply may be needed, for example an electric immersion heater, which may be more expensive and energy demanding than a gas boiler.

Therefore, the processor 218 determines predicted use of hot water and provide information of recommended times for setting the programmer 112 to turn the boiler 102 on and therefore supply sufficient hot water and heating. Likewise, such recommendations and suggestion for modifying the heating system 100 are displayed on the display monitor 222.

Figure 4:
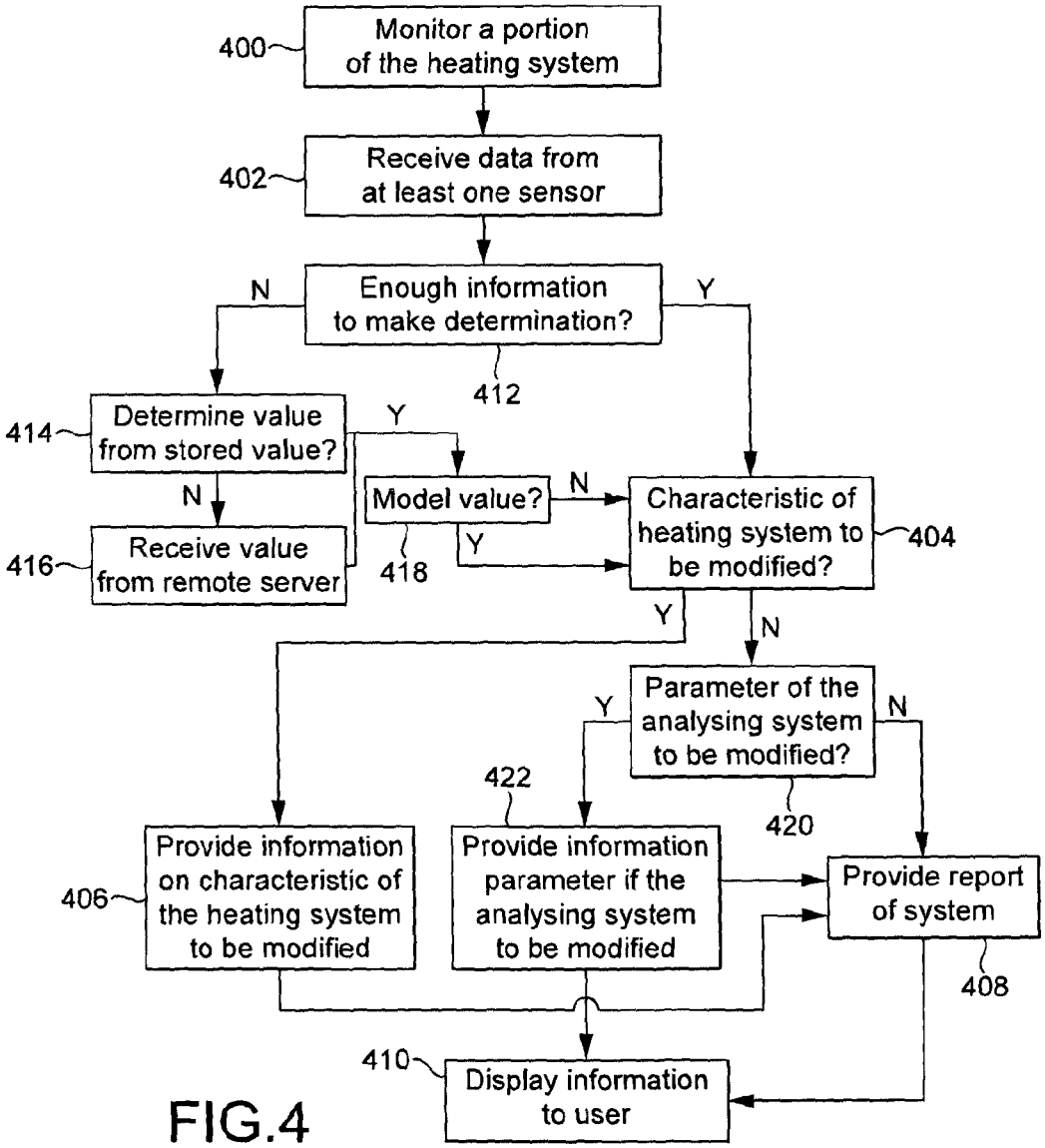
FIG. 4 illustrates a flow diagram representation of a second embodiment of the present invention.

FIG. 4 discloses another embodiment of the apparatus for analysing a heating system according to the present invention. The alternative embodiment is predominantly the same as the previous described embodiment except that the alternative embodiment uses more information to make decisions as to whether characteristics of the heating system should be modified. The step of monitoring a portion of the heating system 400 receiving data from the at least one sensor 402, the step of determining whether a characteristic of the heating system is to be modified 404 providing information on a characteristic of the heating system to be modified 406 or providing report information 408 and displaying information to the user 410 are the same as the first embodiment. In this way, after step 406, the processor 218 generates report information in step 408 including information on the characteristic of the heating system to be modified.

However, after the local server has received information from the wireless sensor 202, 204, 206 and 208 the processor determines on the basis of a pre-stored algorithm whether it requires more data to make a determination. That is, a parameter such as temperature of the hot water tank is not directly determinable from the raw data received from the sensors of the analysing system. This is shown in step 412. If the processor determines that it has sufficient data to make a determination it proceeds to step 404 and completes the process as described in the previous embodiment.

Additionally, the processor 218 decides that it does not have enough information to make a determination. In this way, the processor determines that more data is required in order to determine a characteristic of the heating system. The processor then checks whether it can determine the value from a stored value. In step 414, for example a stored value is a previously known value that is not measurable from the wireless sensors. The value is entered by the user on installation of the apparatus for analysing the heating system or an alternative embodiment embedded in hardware, software or firmware of the apparatus at a factory setting or via a remote update.

For example, the processor 218 may not have the capacity of the boiler stored in its local memory 220.

The processor 218 then determines whether it can obtain the capacity of the boiler via a remote update as shown in step 416. The local server 214 is connected to the internet 226 and sends a message to a remote server 224 for a request regarding the capacity of the boiler. The remote server 224 checks its database 230 on the basis of details of the boiler in the request sent by the local server 214, for example, the request comprises the make and model number of a boiler and the remote server 224 returns the capacity information to the local server.

In an alternative embodiment the processor 218 does not know the make and model number of the boiler. However, the processor 218 determines it has other details stored in local memory 220. For example, the processor determines that it can retrieve the values for the volume of the building and the amount of insulation to the building stored in local memory. The processor 218 then determines that it can model the boiler capacity based on these values as set out in step 418.

In this way, the processor 218 determines a first parameter of the hot water system. For example, the processor determines the temperature of the input and/or output water pipes from a radiator of the hot water system. In some embodiments the first parameter is measurable by the detachable sensors. The processor then determines a second parameter of the hot water system on the basis of the received data of the first parameter. In some embodiments the second parameter is another portion of the hot water system different from the portion of the hot water system which the first parameter relates to. For example, the second parameter is an inaccessible portion of the hot water system. For example, the processor determines the temperature of the hot water in the hot water tank and/or boiler of the hot water system which the detachable sensors may not be able to measure. In some embodiments the second parameter is not measurable by the detachable sensors. In this way the second parameter of the hot water system is determined using the received data of the first parameter and is not directly determinable.

The second parameter may relate to a different portion of the interior energy system than the first parameter. Additionally or alternatively the second parameter relates to a different type of measurement. For example the first parameter may refer to temperature, but the second parameter may refer to calorific consumption of the boiler.

In some embodiments the second parameter is determined from a plurality of parameters. For example the processor 218 receives data from another sensor relating to another portion of the interior energy system. The parameters other than the first parameter may be different from the first parameter. For example in some embodiments, the processor may receive data from different sensors measuring different aspects such as the temperature of two different portions of the interior energy system. In another embodiment, one or more of a plurality of parameters may be determined which are used in turn to determine the second parameter. For example an estimated parameter for the calorific value of gas may be stored in memory.

Similarly, another parameter that the processor may not directly determine from the raw sensor data is the temperature of the hot water tank. The processor 218 is configured to determine unknown parameters and/or characteristics of the heating system 100 from the raw data received from the sensors 202, 204, 206 and 208. The raw sensor data is used to infer the parameter of the heating system. Data received from many different sensors and many different types of sensors are used to infer the temperature of the hot water tank. The flow rates of water in the heating pipe 106, 110 are also determined from many different sensors. A combination of inferred parameters such as water flow rate and the temperature of the hot water tank are used to determine high level characteristics such as fault conditions and diagnosis. In this way, the analysis system is able to determine many different parameters, which are not directly determinable from the raw sensor data and in turn calculate characteristics such as anomalies, faults or efficiency of the heating system 100. In this way, the processor 218 determines a data tree of values or parameters derived from the raw data, some of which may not be directly determinable from the raw sensor data. The data tree includes values inferred, calculated or modelled values determined from the raw sensor data. In turn, inferred, calculated or modelled values can also be determined from other inferred, calculated or modelled values.

When the processor 218 determines that a parameter is not directly determinable from the raw sensor data, the processor is configured to estimate the parameter. The processor is configured to model the parameters to provide a complete data set for determining a characteristic of the heating system.

The algorithms for modelling the heating system and determining parameters of the heating system 100 are typically carried out by processor 218. However, alternatively and/or additionally processor in the remote server 228 also carries out this step. Alternatively, the processor 218 in the local server 214 requests the modelling algorithm from the remote server for future modelling scenarios. After the step of modelling from stored values has been carried out the processor 218 stores the calculated parameter in local memory 220. The processor then determines whether a characteristic of the heating system 100 needs to be modified having determined all the necessary values of the heating system 100.

In an alternative embodiment the processor 218 determines that additional data is required but the processor determines that additional data is derivable from modifying a parameter of the analysing system. This is shown in step 420. For example, the processor 218 determines that additional information can be obtained by moving the ambient temperature sensor 204 to a different position. For example this could identify draughts or other heat sinks in a room or building. Alternatively, the processor 218 determines that additional sensors are required to augment and enrich the sensor data. In this case, the processor 218 determines that information is provided on the parameter of the analysing system to be modified as shown in step 422. Similar to step 406 and 408 the information provided on the parameter of the analysing system to be modified is displayed to the user using the display monitor 222. The processor 218 determines that more information is required to determine a characteristic of the heating system 100. The processor cognitively determines when and what additional data is required. The processor provides information on how to attempt to reconfigure the sensors to receive the additional data. In a modified embodiment, in addition to the information being provided to the user on the display of a user terminal, for example a mobile phone, the processor sends configuration information to the sensors, 202, 204, 206, 208 via the user terminal. In this way, the settings of the sensors are autonomously updated by the processor 218 using the user terminal.

Alternatively the processor determines in step 412 that it does not have enough information to make a judgement regarding a modification of the heating system 100 because it does not have up to date information regarding the latest meteorological and/or seasonal variations. General seasonal information is stored in local memory 220, for example January is in winter and therefore additional heating is provided as required.

However, day-to-day and frequent variations in the weather are determined by the processor 218. The processor 218 requests from the remote server 224, which may be the same server as discussed in the previous embodiments or may be a different remote server. The remote server receives the request for a weather update and sends a weather update in response to information in the request message. The request message, for example, contains geographical information pertaining to the geographic location of the heating system and the building. The processor 218 receives the updated meteorological information and determines in step 404 whether the heating system should be changed.

For example, the weather update informs the processor 218 that the next few days are unusually cold and therefore the processor determines that the heating apparatus is required to overcome the discomfort of the cold period.

In an alternative embodiment the processor determines use of the heating system against other factors. For example, reducing the amount of heating to minimise a carbon footprint or minimising heating usage to reduce the cost of the usage of the heating system. Therefore, in step 404 the processor 218 determines that the reduction of a user's carbon footprint is a priority and determines that the timings and usage of the heating system 100 should be set to a minimum. The processor 218 therefore provides information on setting the heating system in step 406 accordingly.

Optionally, the processor is configured to provide information to the user regarding the user modifying their habits and routine with respect to the heating system in order to meet a criterion mentioned above, such as reducing a carbon footprint. In some embodiments the processor is configured to provide information for modifying a user's behavioural use of the interior energy system. Additionally or alternatively the processor is configured to provide information for modifying the user's behaviour with respect to the building such as opening or closing doors, opening or closing windows, using curtains or using blinds etc.

In a further embodiment the processor determines in step 404 that a priority is for the user to reduce the cost of their energy bill. Therefore, in step 416 the local server has requested to a remote server 224, typically a server from an energy supplier, information regarding energy tariffs. Therefore, in step 404 the processor 218 determines timings and usage of the heating system on the basis of energy tariffs received from an energy supplier's remote server 224. Accordingly, in step 406 information is provided for setting the heating system to minimise the cost of an energy bill. Alternatively and/or additionally the information displayed to the user in step 410 displays a recommended energy tariff that the user should change to.

The processor in step 404 makes determinations against a plurality of criteria. The criteria can be one or more of the following matching supply and demand times and capacity, external factors such as seasonal and meteorological variations, adapting to anomalies and faults detected in the heating system, regulating electrical heating against hydrocarbon heating, minimising power consumption of unused equipment, evaluating and revision of energy tariffs with supplier, and reducing a carbon footprint of a heating system. The user can prioritise and the processor can weight each of these criteria accordingly and balance these criteria against each other.

In an alternative embodiment, the analysing system monitors a plurality of sub-systems of the interior energy system. The processor determines characteristic of a sub-system to be modified on the basis of characteristics and parameters of one or more sub-systems of the interior energy system. As mentioned previously, the interior energy system may include elements or sub-systems causing energy consumption and/or energy generation. The processor determines whether to modify a characteristic of the interior energy system on the basis of a balance between energy consumption and energy generation. Alternatively, the processor determines whether to modify a characteristic of the interior energy system on the basis of a plurality of sub-systems all of which consume energy.

Optionally, the analysing system monitors a plurality of interior energy systems in a plurality of different buildings. Each interior energy system may comprise interior energy sub-systems as mentioned above. The processor 218 of the local server 214 and/or the processor 228 of the remote server 224 analyses the data received from different buildings or zones of buildings and determines whether characteristics of the interior energy systems in the different buildings are to be modified as mentioned previously. The processor determines joint analysis for each building and/or for all of the buildings. For example, statistical analysis is performed across a group of buildings. In this way, the processor determines buildings which require modifications. Additionally, the processor determines the coordination of the interior energy systems to be modified in different buildings (e.g. the buildings with greater energy waste are modified first, or different buildings with similar interior energy systems are modified in different ways in order to maximise the diversity and value of subsequent data from the different buildings).

The local server 214 and/or remote server 224 performs analysis of sensor data jointly and provides joint analysis information for a plurality of interior energy systems. In this way, the analysing system provides determinations and report information for groups larger than a single building. For example analysis for multiple buildings having a common link is performed and generated (e.g. analysis for neighbouring houses on a street or estate, a company having a plurality of office building sites, a university campus having a multiple buildings or an area such as a neighbourhood or town including multiple homes or buildings is performed and generated).

In an additional embodiment the processor alternatively or additionally receives information from sensors associated with an electric power system (not shown). For example an electrical power system could comprise electric heating systems e.g. an immersion heating, electric bar heaters, electric lighting and other electrical appliances. In this way there are two sub-systems of the heating system 100 being an electrical heating system. The system for analysing the electrical power system has a plurality of electrical power consumption sensors. The analysing system includes sensors that measure power consumption at a particular device, for example a plug-through sensor measuring the electrical power consumption of an electric bar heater. Additionally there are other types of electrical power consumption sensor such as sensors measuring the electrical power consumption of a plurality of electrical appliances, for example, a sensor measuring power used at a custom extension block or a sensor measuring the electrical power consumption of an entire building, for example, a sensor at an electrical mains inlet.

In step 404 the process determines which heating subsystem is preferable. For example, the cost of electric heating may be more than the cost of gas heating and therefore gas heating is more preferable. The processor then provides information in step 406 and displays information to the user in step 410 recommending the user reduces the electrical heating system usage.

In steps 414, 416 and 418 the values and parameters determined from a stored local value, a stored remote value or a modelled value may be one or more of the following: the configuration of the system, the location of the sensors, the temperature of the hot water tank, the flow rates of water in the heating pipes, the energy consumption of the boiler, the efficiency of the boiler, the boiler timing settings, the room thermostat setting, the hot water tank thermostat setting, the water and heating timer settings, the boiler burning period, the state of the diverter, the immersion heater usage periods, the hot water usage quantities and periods, degree of thermal insulation in rooms and the hot water tank and the degree of solar heating in each room.

In an additional embodiment, further sensors (not shown) are provided to detect whether a window is open in a room. The processor 218 then provides recommendations and feedback to the user to modify the heating of rooms with windows open.

In a further embodiment, there is a combination of features as presented in one or more of the previous mentioned embodiments.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

For example the embodiments of the invention may be implemented as a chipset or a single integrated circuit, in other words a series of integrated circuits communicating among each other. The chipset may comprise microprocessors arranged to run code, application specific integrated circuits (ASICs), or programmable digital signal processors for performing the operations described above.

The embodiments of this invention may be implemented by computer software executable by a data processor of the local server, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs) and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jos; Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples of some embodiments of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus for analysing an interior energy system comprising:

a processor configured to:

receive data of a first parameter of the interior energy system from at least one sensor, the at least one sensor being arranged to monitor a portion of the interior energy system;

determine a second parameter of the interior energy system using the received data of the first parameter; and determine a characteristic of the interior energy system from the determined second parameter;

wherein the processor is configured to determine if further data is required for determining the second parameter of the interior energy system on the basis of the received sensor data;

wherein if further data is required, the processor is configured to determine when the further data is required and what further data is required, and wherein the processor is configured to provide information on how to reconfigure the at least one sensor to receive the further data.

2. The apparatus according to claim 1, wherein the second parameter relates to another different portion of the interior energy system.

3. The apparatus according to claim 1, wherein the second parameter is not directly determinable with the at least one sensor.

4. The apparatus according to claim 1, wherein the processor is configured to provide information comprising an analysis of the interior energy system based on the determined characteristic.

5. The apparatus according to claim 1, wherein the processor is configured to determine the second parameter on the basis of the received data of the first parameter and a stored value.

6. The apparatus according to claim 5, wherein the stored value is inputted by the user, received from a remote server, or installed as a factory setting.

7. The apparatus according to claim 6, wherein the processor is configured to determine the second parameter using a modeling algorithm and the received data.

8. The apparatus according to claim 7, wherein the information comprises a recommendation for a user to modify their behavioural use of at least one of the interior energy system or the building.

9. The apparatus according to claim 8, wherein the information comprises at least one of the following: a suggested modified configuration of all or a portion of the interior energy system, detection of a fault in all or a portion of the interior energy system, or maintenance in all or a portion of the interior energy system.

10. The apparatus according to claim 9, wherein the information comprises an indication to manually adjust the configuration of at least a portion of the interior energy system.

11. The apparatus according to claim 9, wherein the interior energy system is at least one of the following: an electric heating system, a gas heating system, an oil heating system, a combined heat and power system, a bio-fuel power system, a solid fuel heating system, a hot water system, an electrical supply system, or an air conditioning system.

12. The apparatus according to claim 9, wherein the processor is configured to determine if further data is required for determining a characteristic of the interior energy system on the basis of the received sensor data.

13. The apparatus according to claim 9, wherein the processor is configured to determine a parameter of the at least one sensor to modify on the basis on the data.

14. The apparatus according to claim 13, wherein the processor is configured to provide information on the parameter of the at least one sensor to be modified.

15. The apparatus according to claim 14, wherein the parameter of the at least one sensor is at least one of the following: location or configuration of the at least one detachable sensor, or timing configuration of when the at least one sensor monitors the interior energy system.

16. The apparatus according to claim 1, wherein the information comprises a request for additional sensors to monitor the interior energy system and to send data to the apparatus.

17. The apparatus according to claim 16, wherein the first and second parameter is one or more of the following parameters: a temperature of a hot water tank of the interior energy system, the flow rates of the water in pipes of the interior energy system, calorific consumption of a boiler of the interior energy system, the efficiency of the boiler of the interior energy system, timer settings of the interior energy system, settings of at least one thermostat of the interior energy system, burning periods of the boiler, usage periods of the interior energy system, a quantity of insulation of the building, a quantity of solar heating of the building, a temperature of one or more pipes, a temperature of water in one or more pipes and a temperature of water in the hot water tank or other water bearing component of the interior energy system, heat transfer between components of the interior energy system or interior or exterior portions of the building, a position of at least one valve of the interior energy system, dimensions of at least one component of the interior energy system, or dimensions of at least one portion of the building.

18. The apparatus according to claim 17, wherein the processor is configured to receive the data from the at least one sensor via a wireless network.

19. The apparatus according to claim 18, wherein the processor is configured to receive the data from the at least one sensor via a hub and over a wireless network.

20. The apparatus according to claim 18, wherein the processor is configured to further determine a characteristic of the interior energy system to be modified on the basis of data regarding meteorological information and seasonal information.

21. The apparatus according to claim 20, wherein the data regarding the external factors is received from a remote server and is stored in the apparatus.

22. The apparatus according to claim 20, wherein the processor is configured to further determine a characteristic of the interior energy system on the basis of timing data of when the climate system in use.

23. The apparatus according to claim 20, wherein the at least one sensor is a temperature sensor configured to monitor one or more of the following: a heating pipe of the interior energy system, a water pipe, the ambient temperature of a portion of the building, the temperature of a radiator of the interior energy system, the temperature of a hot water tank of the interior energy system, and the temperature of an object which is in a portion of the building.

24. The apparatus according to claim 20, wherein the characteristic determined by the processor is one or more of the following: the energy consumption in the interior energy system, the efficiency of the interior energy system, faults of the interior energy system, required maintenance of the interior energy system, the energy generation of the interior energy system and potential improvements of the interior energy system.

25. The apparatus according to claim 20, wherein the processor provides information to improve the efficiency of the interior energy system.

26. The apparatus according to claim 20, wherein the at least one sensor is an electrical power consumption sensor configured to monitor one or more of the following: a single electrical appliance, a plurality of electrical appliances, and all electrical appliances in a building.

27. The apparatus according to claim 1, wherein the interior energy system comprises at least two different interior energy sub-systems and the processor is configured to determine a characteristic of one or both of the interior energy sub-systems.

28. The apparatus according to claim 27, wherein the processor is configured to compare the sub-systems on the basis of the characteristics and provide information of the comparison.

29. The apparatus according to claim 28, wherein the interior energy sub-systems are one or more of the following: an electric heating system, a gas heating system, a solid fuel heating system, a hot water system, an air conditioning system, an electrical supply system, an oil heating system, a combined heat and power system, and a bio-fuel power system.

30. The apparatus according to claim 28, wherein the second parameter is not directly measurable from the received data.

31. The apparatus according to claim 28, wherein installation of the apparatus is non-disruptive such that no modification or replacement of the interior energy system is required.

32. The apparatus according to claim 28, wherein the processor is configured to determine parameters in order of a priority of the parameters.

33. The apparatus according to claim 32, wherein the processor is configured to access a data tree comprising a hierarchical evaluation the parameters.

34. The apparatus according to claim 1, wherein the processor is further configured to determine the second parameter from one or more parameters other than the first parameter.

35. The apparatus according to claim 34, wherein the processor receives data for the one or more parameters from one or more other sensors.

36. A user terminal comprising the apparatus according to claim 1, wherein the user terminal is at least one of the following: a server, a personal computer, a mobile telephone, a personal digital assistant, and a laptop.

37. The apparatus according to claim 1, wherein the sensor is detachable.

38. A system for analysing an interior energy system comprising:

at least one sensor arranged to monitor a portion of the interior energy system; and an apparatus comprising a processor configured to:

receive data of a first parameter of the interior energy system from the at least one sensor;

determine a second parameter of the interior energy using the received data of the first parameter; and determine a characteristic of the interior energy system from the determined second parameter;

wherein the processor is configured to determine if further data is required for determining the second parameter of the interior energy system on the basis of the received sensor data;

wherein if further data is required, the processor is configured to determine when the further data is required and what further data is required, and wherein the processor is configured to provide information on how to reconfigure the at least one sensor to receive the further data.

39. The system according to claim 38, wherein the sensor is detachable.

40. A method of analysing an interior energy system comprising:

receiving, at a receiver, data of a first parameter of the interior energy system from at least one sensor arranged to monitor a portion of the interior energy system;

determining, at a processor, a second parameter of the interior energy system using the received data of the first parameter;

determining, at the processor, a characteristic of the interior energy system from the determined second parameter, wherein the second parameter relates to another different portion of the interior energy system than the first parameter;

determining, at the processor, if further data is required for determining the second parameter of the interior energy system on the basis of the receiver sensor data; and if further data is required, determining, at the processor, when the further data is required and what further data is required, and providing information on how to reconfigure the at least one sensor to receive the further data.

41. A computer program comprising code embodied in a non-transitory computer readable medium adapted to perform the method of claim 40 when the program is run on a processor.

* * * * *